United States Patent [19]

Peytavin

[11] 4,196,770

[45] Apr. 8, 1980

[54] DEVICE FOR CONTINUOUS CASTING OF LIQUID METAL ESPECIALLY STEEL

[75] Inventor: Pierre Peytavin, Neuilly-sur-Seine, France

[73] Assignee: Creusot-Loire-Valiourec, Neuilly-sur-Seine, France

[21] Appl. No.: 902,878

[22] Filed: May 4, 1978

[30] Foreign Application Priority Data

May 6, 1977 [FR] France ..... 77 13852

[51] Int. Cl.[2] ..... B22D 11/12

[52] U.S. Cl. ..... 164/442; 164/422

[58] Field of Search ..... 164/262, 263, 441, 442, 164/447, 448, 82, 422

[56] References Cited

U.S. PATENT DOCUMENTS

| | | | |
|---|---|---|---|
| 3,375,862 | 4/1968 | Boitchenko et al. | 164/441 |
| 3,430,684 | 3/1969 | Bebel et al. | 164/422 |
| 3,702,630 | 11/1972 | Peytavin et al. | 164/82 |

FOREIGN PATENT DOCUMENTS

| | | | |
|---|---|---|---|
| 1572375 | 6/1969 | France | 164/442 |

*Primary Examiner*—Robert D. Baldwin
*Assistant Examiner*—K. Y. Lin
*Attorney, Agent, or Firm*—Brisebois & Kruger

[57] ABSTRACT

A continuous vertical casting line includes an elongated vertical casing of U-shaped section with a continuous casting mold at the upper end of the casing. Within the casing are rotatable support rings for supporting guiding rollers along the axis of the blank cast by the casting mold. The roller portion of the casing supports an extractor in the form of a single pair of extraction rollers. The extraction rollers are mounted on a support rotatable by a mechanism in a stationary base. The roller support is removably retained on its base, and the base is removably retained in the casing. The arrangement permits substantial reduction in weight of the casting line and simplifies both the construction of the casting line and the removal and replacement of components.

4 Claims, 3 Drawing Figures

DEVICE FOR CONTINUOUS CASTING OF LIQUID METAL ESPECIALLY STEEL

The present invention relates to apparatus for continuous casting of metal, and especially of steel. The apparatus is of the vertical type, that is, one in which the bar or blank of cast steel descends vertically gradually as it is cooled.

Devices for continuous casting of liquid metal and especially of steel are already known in which the steel contained in a ladle is poured into a vertical axis, mold or ingot mold which is force cooled in such a way that the cast metal is extracted in the form of a bar while solidification occurs at the lower part of the ingot mold. Some of these devices allow the continuous rotary casting of metals such as steel and comprise for this purpose an ingot mold capable of rotating around its own vertical axis, guiding rollers disposed below the ingot mold in a cooling zone to maintain the rotating cast bar in vertical alignment, an extractor comprising a cage rotating around a vertical axis and provided at its interior with multiple pairs of extraction rollers symmetrical in relation to the axis and disposed at different levels, the cage being driven in rotation by motor means and the rollers likewise being driven by motor means, a cut-off mechanism comprising, for example, a saw joined to a clamp driven temporarily by the bar to cut it, and a tilt mechanism receiving the cut sections and conducting them from the vertical position to a horizontal position to discharge them.

Known devices require the construction of complex structures which either are not sufficiently rigid, especially in the case of rotary casting of significant tonnage, or else are too bulky and restricted to maintain especially when one wants to group several casting lines side-by-side.

In addition, these devices are relatively expensive, the cost depending principally on the number, weight and complexity of the components of a casting line. Finally, repairs are difficult because of the weight of the constituents, especially when complete elements of the device must be changed for replacement, for example after an accidental breakthrough of the liquid metal.

The present invention proposes to remedy these disadvantages and to provide a simpler device which is more economical to realize. The invention likewise proposes in such a device to diminish the weight of the constituents. Another object of the invention is to considerably facilitate maintenance or the replacement of certain parts or components.

Another object of the invention is to also lighten at least partially the superstructure which supports the assembly of the casting line, by diminishing the weight intended to be carried by the platforms.

The invention has as an object a device for continuous casting of liquid metal, especially steel, comprising at least one line for continuous vertical casting with a mold, preferably rotary, disposed at the upper part, means for supplying the mold with liquid metal, a cooling zone with guiding rollers under the mold, an extractor with a single assembly of motor-driven rollers, a cut-off device and a tilt mechanism, characterized by the fact that it comprises a rigid elongated structure, having the form of a vertical elongated casing of essentially U-shaped section extending between the mold and the lower part of the extractor, the casing having means to support at its interior, with regulated axial alignment, at least one pair of guiding rollers and means to support the extractor which has a single pair of motor-driven rollers, at the lower part of the casing.

The rollers are driven in rotation by suitable motor means and can be advantageously pushed against the bar by elastic means, preferably helical springs, in such a way that the more the rollers are spaced from the bar axis, the greater is the pressure on the springs, which permits an automatic adaptation of the pressure of the springs to the diameter and thus to the weight of the suspended bar.

In one preferred embodiment of rotary continuous casting in which the bar is driven in rotation around its own axis, the pair of rollers is mounted on a driving device comprising a fixed preferably circular base, a mobile gear capable of turning in rotation on or in the fixed base, the movable gear having means enabling it to removably receive the pair of rollers, and conventional means for differential driving of the movable gear in rotation around the vertical axis and the rollers in rotation around their horizontal axis.

It is thus possibie to separately move the pair of rollers, which rollers are preferably readily mountable on a stand capable of being removably fixed on the movable gear, and the fixed base with its gear, which permits the transport of only one of these two elements and thus permits a reduction of the superstructure platform at the access zone of the extractor.

In addition, the gain which is obtained from a point of view of inertia of the extractor permits the motor drive arrangement to be simplified.

Other advantages and characteristics will be apparent to the reader of the following description, given as a non-limiting example and referring to the attached drawings, in which.

Figure 1:
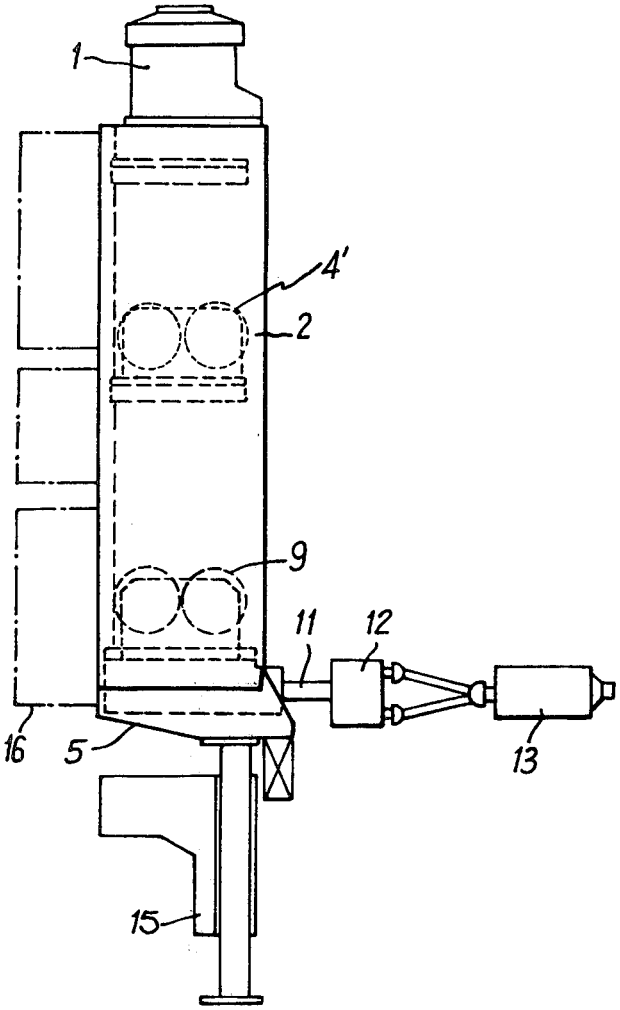
FIG. 1 is a schematic view in elevation of one part of a device according to the invention.
Figure 2:
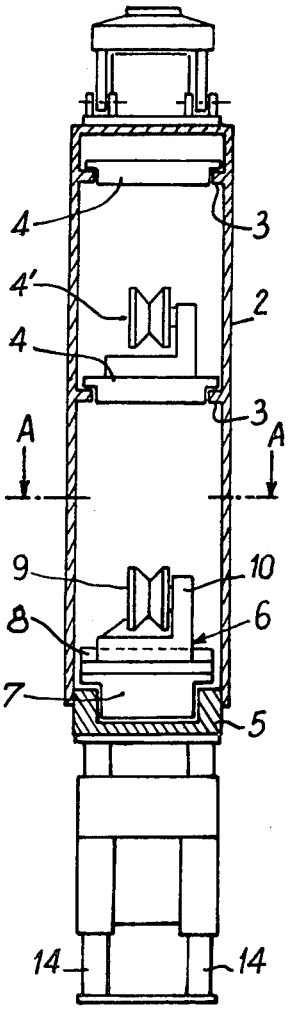
FIG. 2 is a side view of this device.
Figure 3:
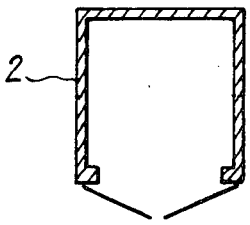
FIG. 3 is a horizontal section of the housing of the device.

The apparatus schematically shown permits the continuous rotary vertical casting of liquid steel. It comprises an ingot mold generally designated by 1, the ingot mold being mounted rotatably in a suitable framework and being in addition provided with means causing vertical oscillation simultaneously with its rotation. The means for cooling of the ingot mold have not been shown either.

Below the ingot mold is a casing 2 of generally U-shaped section made in a way to have great rigidity. The upper part of this casing supports the ingot mold and all its apparatus. It can be seen that inside casing 2 which is U-shaped, there are axially spaced bearing surfaces schematically designated by 3, the bearing surfaces supporting, by means of conventional bearings or rolling mechanisms not shown, center rests 4 rotatable about the vertical axis, one of which is located toward the upper portion of the housing, the other in its middle portion. These steady rests 4 are of standard construction and provide for mounting, in each of the steady rests, a pair of guiding wheels or rollers 4 with elastic means pressing the rollers symmetrically toward the vertical axis in order to assure the guiding of the extracted bar along the vertical axis.

At the lower part of the housing is a support surface 5 for supporting an extractor assembly 6. Assembly 6 has a fixed base 7 inside of which can turn a mobile gear 8 on which one can fix a pair of extraction rollers 9 mounted on a support 10 capable of being fixed in a removable fashion on the movable part 8. The movable gear 8 has means for driving rollers 9 in rotation around their horizontal axis, these means comprising means for rapid connection.

Two coaxial shafts designated in their assembly by 11 and driven from differential means 12 by a motor 13 permit both the driving in rotation of gear 8 in base 7 and the driving in rotation through the mobile gear 8 of rollers 9 at a given speed around their axis by the action of transmission means of a standard type already known in casting installations.

Below housing 2 is a cut-off zone with a sliding carriage 15 mobile in translation on guiding columns 14 and having a rotative jaw and a pivoting saw not shown.

When one wants to come in to the extractor, one reaches there by a platform located essentially level with 16 and one disconnects the two coaxial shafts 11 from device 7. Support 10 with its rollers 9 is then disconnected from the rotative part 8, following which structure 10 is, for example by a handling carriage, displaced away on platform 16.

Then all that remains is to raise the base 7 to conduct it in the same way, preferably on sliding means advantageously provided on support 5, to permit the initial translation of the framework 7 out of the housing.

For a continuous casting installation for steel to make bars going for example from 100 mm to 350 mm. in diameter, the total weight of the extractor according to the invention is 6 tons, that is, 3 tons for assembly 7, 8, and 3 tons for assembly 9, 10 while standard extractors have for similar performance, a weight on the order of 20 tons.

Thus it can be seen that in addition to the simplicity and the economic advantage, the invention greatly assists the operations of maintenance and handling at the extractor level while permitting the use of less reinforced platforms at this level and lightening consequently the superstructure which supports the line.

Although the invention has been described with respect to a particular embodiment, it is of course understood that it is in no way limited and that various modifications and variations can be made.

I claim:

1. In apparatus for continuous casting of liquid metal, particularly steel, to continuously form a cast blank, said apparatus including at least one vertical casting line having a mold disposed at the upper portion of the line, means for supplying said liquid metal to the mold, a cooling zone with guiding rollers under the mold, and an extractor including motor driven rollers, the improvement comprising an elongated rigid structure in the form of an elongated vertical casing of essentially U-shaped transverse section having one side open, and extending between the base of said mold and the lower portion of said extractor, said casing having means to receive and support therein at least one pair of guiding rollers, and support means disposed on the lower portion of the casing to receive the extractor, said extractor comprising a single pair of extraction rollers positioned symmetrically with respect to said casting line.

2. Apparatus according to claim 1 for a continuous rotative casting, in which the cast blank is driven in rotation around its own axis, characterized by the fact that said single pair of extraction rollers is mounted on a driving device comprising a stationary base, a movable assembly capable of turning in rotation in the said stationary base, said movable assembly including means for receiving the pair of extraction rollers.

3. Apparatus according to claim 2, characterized by the fact that the pair of extraction rollers is mounted on a support fixed on the movable assembly.

4. Device according to claim 2, characterized by the fact that the casing has free turning steady rests supporting said guiding rollers, and at the lower part of the casing a support to receive the stationary base of the extractor.

* * * * *